US007186934B2

(12) United States Patent
Nakajima

(10) Patent No.: US 7,186,934 B2
(45) Date of Patent: Mar. 6, 2007

(54) PRESSURE SWITCH

(75) Inventor: Kaoru Nakajima, Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 11/336,451

(22) Filed: Jan. 20, 2006

(65) Prior Publication Data

US 2006/0219537 A1 Oct. 5, 2006

(30) Foreign Application Priority Data

Mar. 31, 2005 (JP) ..... 2005-103765

(51) Int. Cl.
*H01H 35/36* (2006.01)

(52) U.S. Cl. ..... 200/81 R; 200/83 R

(58) Field of Classification Search ..... 200/81 R, 200/82 R, 83 R, 83 A, 83 J, 83 N, 83 P
See application file for complete search history.

(56) References Cited

U.S. PATENT DOCUMENTS 5,181,522 A * 1/1993 McEwen ..... 600/561
5,519,179 A * 5/1996 Sato ..... 200/83 N
5,549,785 A * 8/1996 Sakai et al. ..... 438/52
5,986,224 A * 11/1999 Kent ..... 178/18.04
6,525,997 B1 * 2/2003 Narayanaswami et al. .. 368/223
2002/0075513 A1 * 6/2002 Yogome et al. ..... 358/1.15
2003/0064758 A1 * 4/2003 Mizuta et al. ..... 455/566
2004/0204059 A1 * 10/2004 Wong et al. ..... 455/556.1
2005/0090288 A1 * 4/2005 Stohr et al. ..... 455/566

FOREIGN PATENT DOCUMENTS

JP 2000-173377 6/2000

* cited by examiner

*Primary Examiner*—K. Lee
(74) *Attorney, Agent, or Firm*—Peter Ganjian

(57) ABSTRACT

An indication displayed by a display unit included in a pressure switch is inverted and the respective setting functions of push-button switches are reversed when the operator is obliged to look at the display unit from a direction opposite a normal looking direction or when the pressure switch is installed in an inverted position. A mode setting push-button switch 113 is operated to turn the indication indicating a set pressure displayed by a display unit 116 through an angle of 180°, a function to increase the set pressure of a first push-button switch 111 is reversed and a function to decrease the set pressure of the second push-button switch 112 is reversed.

1 Claim, 9 Drawing Sheets

PRESSURE SWITCH

BACKGROUND OF THE INVENTION

1. Field of the Invention

The present invention relates to a pressure switch capable of sending a detection signal to an external device when a measured pressure of a pressurized fluid measured by a pressure sensor coincides with a predetermined set pressure.

2. Description of the Related Art

A known vacuum carrying device put a suction cup on a workpiece, creates a partial vacuum in the suction cup to hold the workpiece by the vacuum on the suction cup and carries the workpiece held by the suction cup to a predetermined position. A pressure switch is used to confirm the creation of a predetermined vacuum in the suction cup and to ensure that the workpiece is securely attracted to the suction cup by suction.

The pressure switch is provided with a pressure sensor for measuring a vacuum created in the suction cup. The pressure switch decides that the suction cup has firmly held the workpiece upon the coincidence of a measured pressure measured by the pressure sensor with a predetermined pressure and sends a complete attraction detection signal indicating the complete attraction of the workpiece by the suction cup to, for example, an external controller.

A pressure switch of this kind disclosed in, for example, JP-A 2000-173377 is provided with a display unit for displaying a set pressure.

When this known pressure switch is incorporated into a work carrying apparatus or the like, the operator is supposed to read the set pressure displayed by the display unit from a predetermined direction, namely, a reading direction, and to operate operating buttons or the like from a predetermined direction, namely, an operating direction. Even if the environment in which the pressure switch is installed does not allow the operator to read the set pressure and to operate the operating buttons from the fixed reading and the fixed operating direction, the set pressure cannot be read from a direction opposite the reading direction and the operating buttons cannot be operated from a direction opposite the operating direction.

The known pressure switch needs to be connected to the suction cup by a line for carrying a fluid of a negative pressure and needs to be installed fixedly at a predetermined position. Consequently, the set pressure displayed by the display unit can be read only from a fixed reading direction and the buttons need to be arranged in a fixed direction.

Therefore, if the arrangement of the pressure switch is changed and the operator is obliged to look at the set pressure from a direction opposite the predetermined direction and the operating buttons are arranged inevitably in a direction opposite the predetermined direction, it is possible that the operator fails in reading the set pressure correctly and the operator is liable to fail in correctly operating the operating buttons. Such problems arise also when the pressure switch is installed in an inverted position.

SUMMARY OF THE INVENTION

Accordingly, it is an object of the present invention to provide a pressure switch provided with a display unit and operating buttons, and capable of inverting an indication of a set pressure displayed by the display unit and inverting the operating sequence of the operating buttons when a reading direction from which the operator reads the indication is changed.

An aspect of the present invention is directed to a pressure switch including: a first push-button switch, a second push-button switch, a pressure sensor, a display unit for displaying a set pressure indication, a storage device storing programs, and a CPU that executes instructions specified by the programs, increases a set pressure when the first push-button switch is operated, decreases the set pressure when the second push-button switch is operated, makes the display unit display the set pressure and provides a detection signal upon the coincidence of a measured pressure measured by the pressure sensor with the set pressure; wherein an indication turning push-button switch is connected to the CPU, the CPU turns the set pressure indication displayed by the display unit through an angle of 180° and executes, when the indication turning push-button switch is operated, a program for reversing a setting function of the first push-button switch to increase the set pressure when the first push-button switch is operated and for reversing a setting function of the second push-button switch to decrease the set pressure when the second push-button switch is operated.

According to the aspect of the present invention, when the operator is obliged to look at the display unit of the pressure switch from an opposite direction or when the pressure switch is installed in an inverted position, the indication turning push-button is operated to turn the set pressure indication displayed by the display unit through an angle of 180° and to reverse the respective setting functions of the first and the second push-button switch.

According to the aspect of the present invention, even if the operator is obliged, for example, to look at the display unit of the pressure switch from an opposite direction or the pressure switch is installed in an inverted position, the operator is able to read erect numerical indication indicating the set pressure. Since the respective setting functions of the first and the second push-button switch are interchanged, i.e., the respective setting functions of the first and the second push-button switch are reversed, the operator does not need to change the sense of operating the first and the second push-button switch even if the pressure switch is installed in an inverted position; that is, for example, the push-button switch on the right side is always for increasing the set pressure and the push-button switch on the left side is always for decreasing the set pressure.

Consequently, according to the aspect of the present invention, even if the operator is obliged, for example, to look at the display unit of the pressure switch from an opposite direction or the pressure switch is installed in an inverted position, the operator is able to read the indication correctly and does not need to change the sense of operations for increasing and decreasing the set pressure.

According to the aspect of the present invention, when the reading direction from which the operator reads the indication is changed or the position of the pressure switch is changed to conform to the change of the environment in which the pressure switch is installed, the set pressure indication displayed by the display unit can be inverted and the respective setting functions of the first and the second push-button switch can be inverted.

BRIEF DESCRIPTION OF THE DRAWINGS

Embodiments of the present invention will be described in detail based on the following figures, wherein.

DESCRIPTION OF THE PREFERRED EMBODIMENTS

Preferred embodiments of the present invention will be described with reference to the accompanying drawings.

Figure 1:
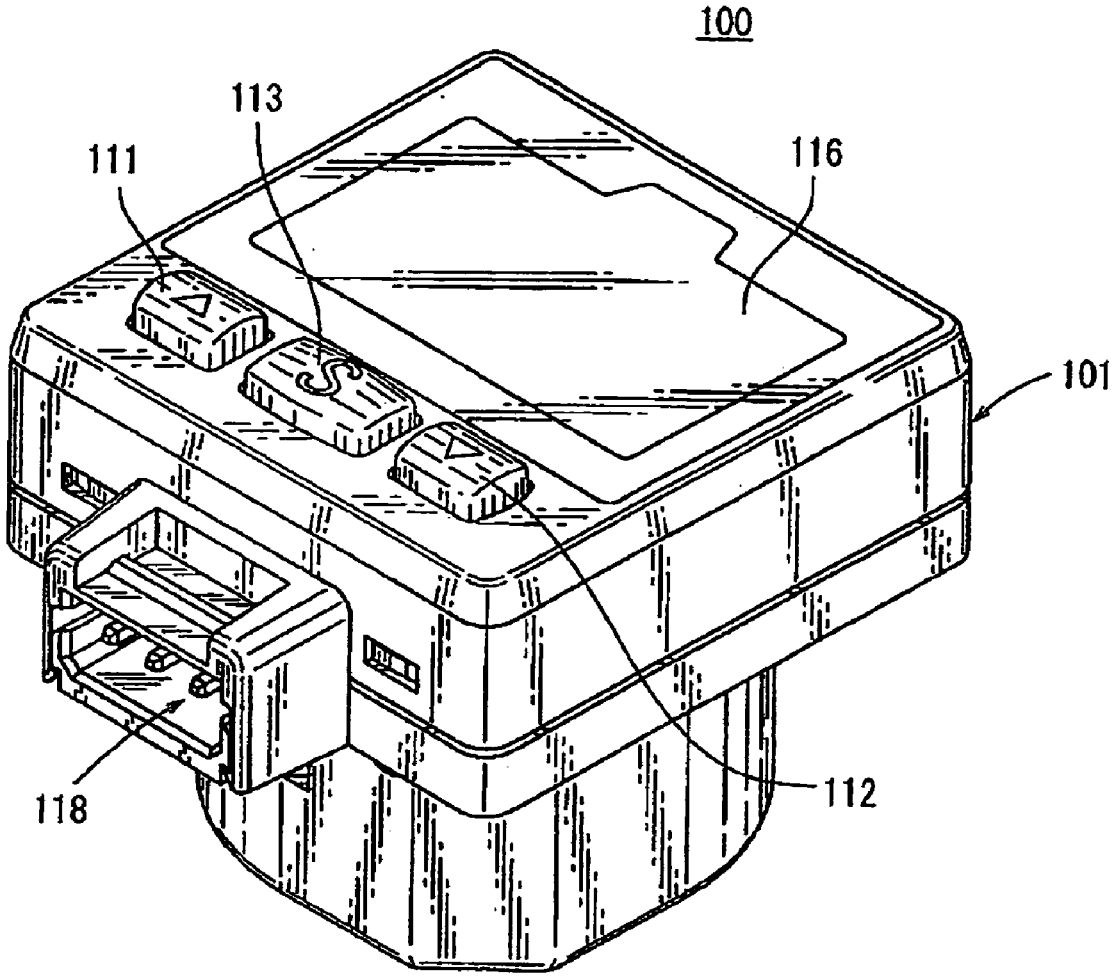
FIG. 1 is a perspective view of a pressure switch in a preferred embodiment according to the present invention.

FIG. 1 is a perspective view of a pressure switch 100 in a preferred embodiment according to the present invention.

Figure 2:
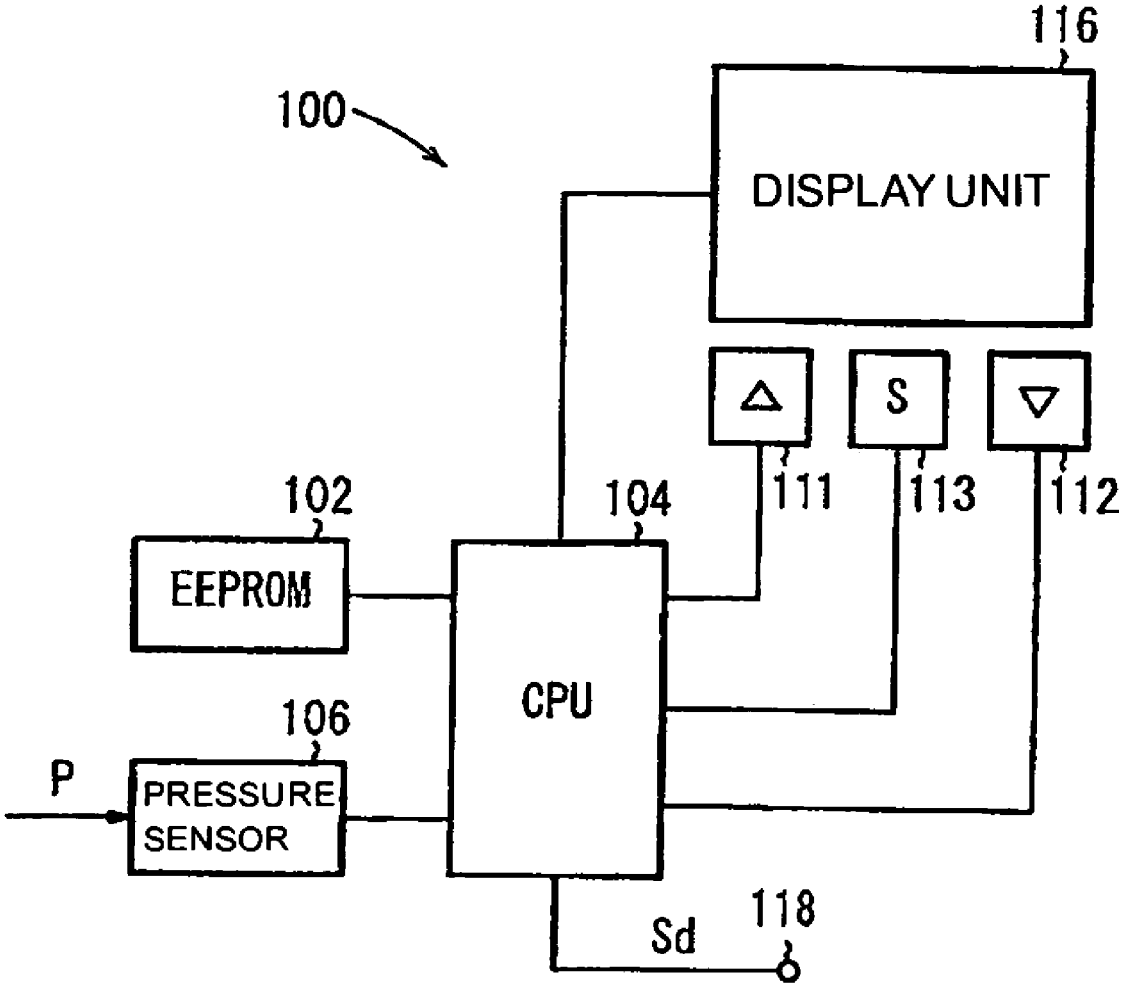
FIG. 2 is a block diagram of an electric circuit included in the pressure switch shown in FIG. 1.

FIG. 2 is a block diagram of an electric circuit included in the pressure switch 100.

Figure 3:
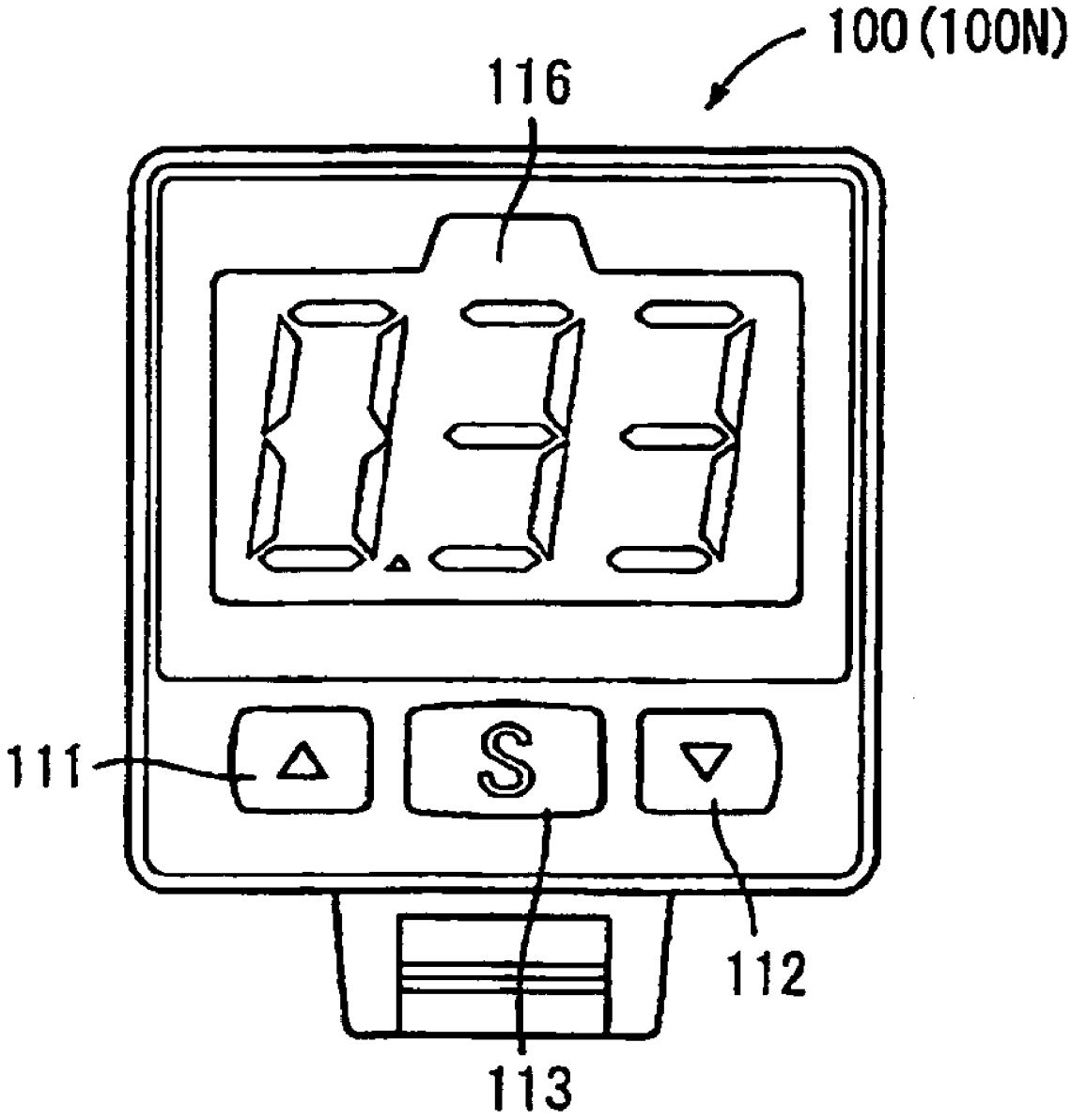
FIG. 3 is a front elevation of the pressure switch shown in FIG. 1 disposed in a normal position.

FIG. 3 is a front elevation of the pressure switch 100 disposed in a normal position. When necessary, the pressure switch 100 disposed in a normal position will be designated by 100N.

Figure 4:
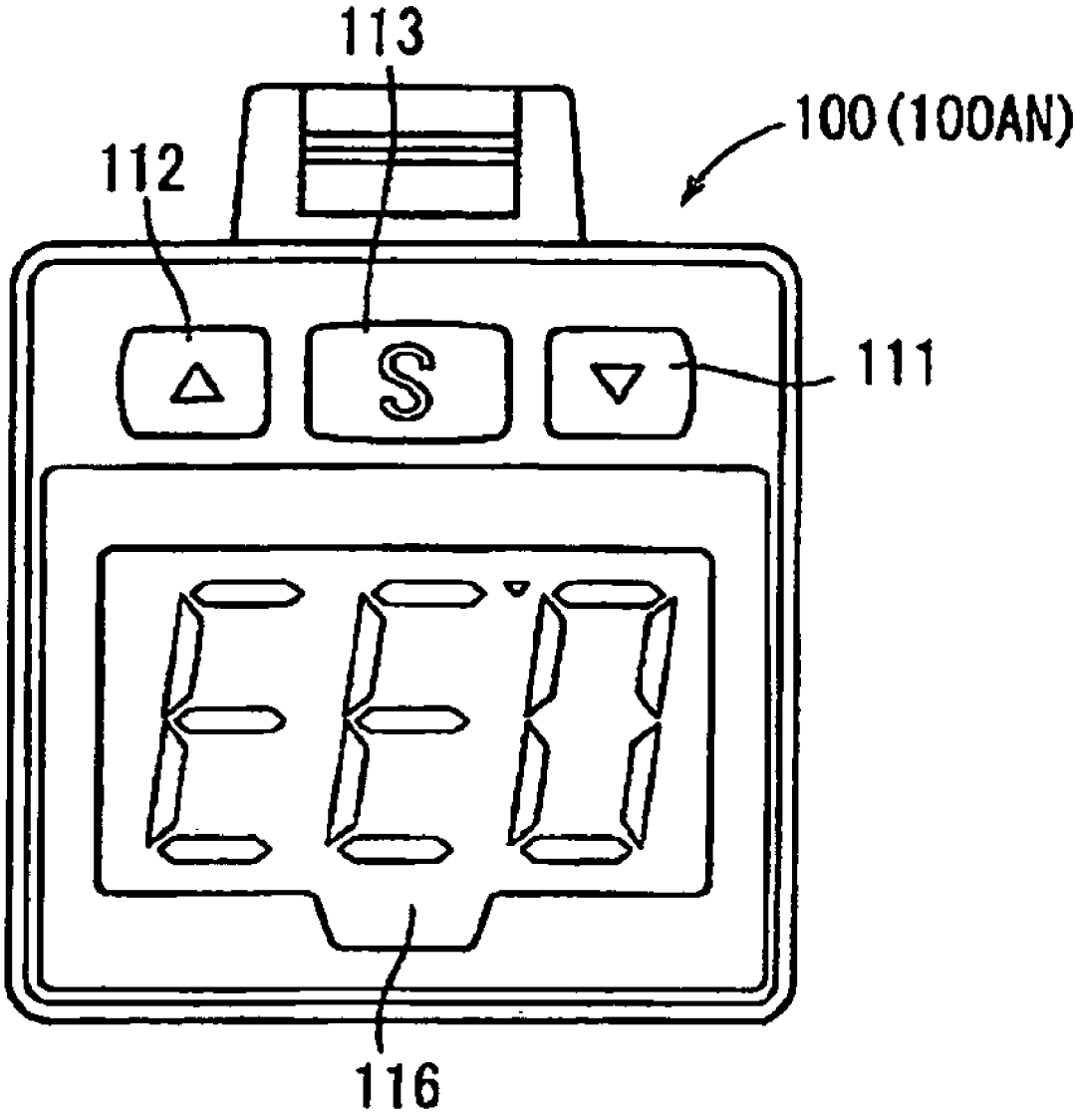
FIG. 4 is a front elevation of the pressure switch shown in FIG. 1 disposed in an inverted position.

FIG. 4 is a front elevation of the pressure switch 100 disposed in an inverted position. When necessary, the pressure switch 100 disposed in an inverted position will be designated by 100A.

Figure 5:
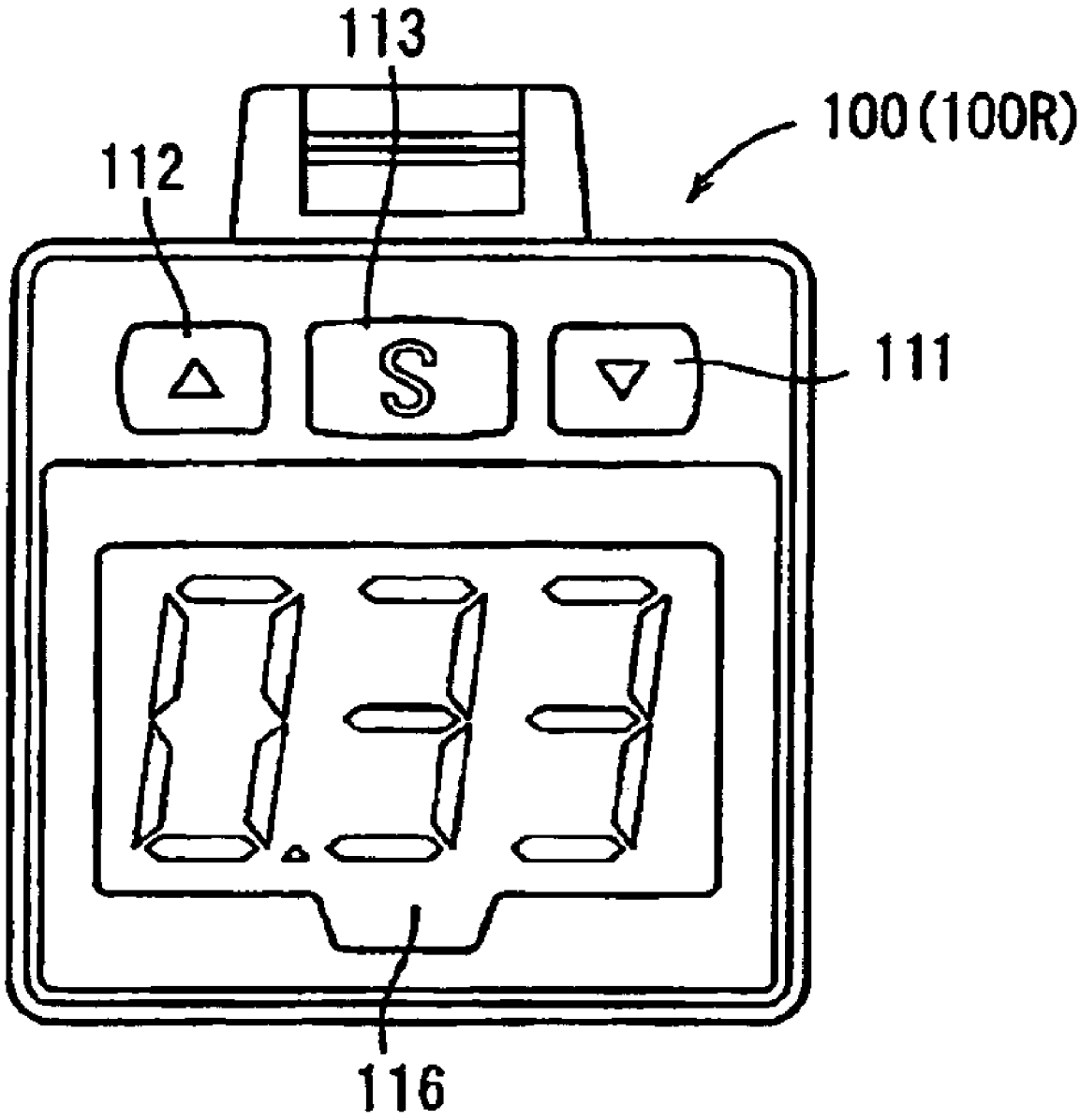
FIG. 5 is a front elevation of the pressure switch shown in FIG. 1 disposed in an inverted position in a state after an indication displayed on the pressure switch has been turned through an angle of 180°.

FIG. 5 is a front elevation of the pressure switch 100 disposed in the inverted position in a state after an indication displayed on the pressure switch 100 has been turned through an angle of 180°. When necessary, the pressure switch 100 in this state will be designated by 100R.

As shown in FIG. 1, the pressure switch 100 has a casing 101 formed by combining an upper case and a lower case. An electrical wiring board, not shown, is sealed in the casing 101.

Referring to FIGS. 2 and 3, the pressure switch 100 includes an electrically erasable and programmable read-only memory EEPROM (electrically erasable and programmable read-only memory) 102 for storing programs and data, a CPU 104 that executes the programs stored in the EEPROM 102 to serve as various functional means including a mode changing means for setting the pressure sensor 100 in a setting mode or a measuring mode, an indication turning means (indication inverting means), a switching function reversing means and a comparing means for comparing a set pressure and a measured pressure, and a pressure sensor 106 for sensing the pressure P of a pressurized fluid.

Referring to FIG. 3 showing the pressure switch 100 disposed in a normal position, the push button marked with a triangle of a first push-button switch 111, the push button marked with an inverted triangle of a second push-button switch 112 and the push button marked with an S of a mode setting push-button switch 113 that serves also as an indication turning push-button switch are arranged in a lateral row on the front surface of the pressure switch 100.

A substantially rectangular 7-segment liquid crystal display included in a display unit 116 is placed on the front surface of the pressure switch 100 above the push buttons of the push-button switches 111, 112 and 113.

In FIG. 3, the display unit 116 displays an indication indicating a set pressure of 0.33 kPa.

The EEPROM 102, the pressure sensor 106, the push-button switches 111 to 113 and the display unit 116 are electrically connected to the CUP 104. The CPU 104 executes the programs stored in the EEPROM 102 and specified by signals provided by operating the push-button switches 111 to 113 to carry out the functions of the mode setting means, the indication turning means, the switching function reversing means and the comparing means.

When the CPU 104 operates as the comparing means in the measuring mode, the CPU 104 provides a coincidence signal Sd at an output terminal 118 upon the coincidence of a measured pressure P measured by the pressure sensor 106 with the set pressure set in the setting mode.

The output terminal 118 is one of connecting pins shown in FIG. 1. A connector, not shown, attached to a cable connected to an external device, such as a controller, is electrically connected to the connecting pins. The coincidence signal Sd is transmitted by the cable to the external device.

Figure 6:
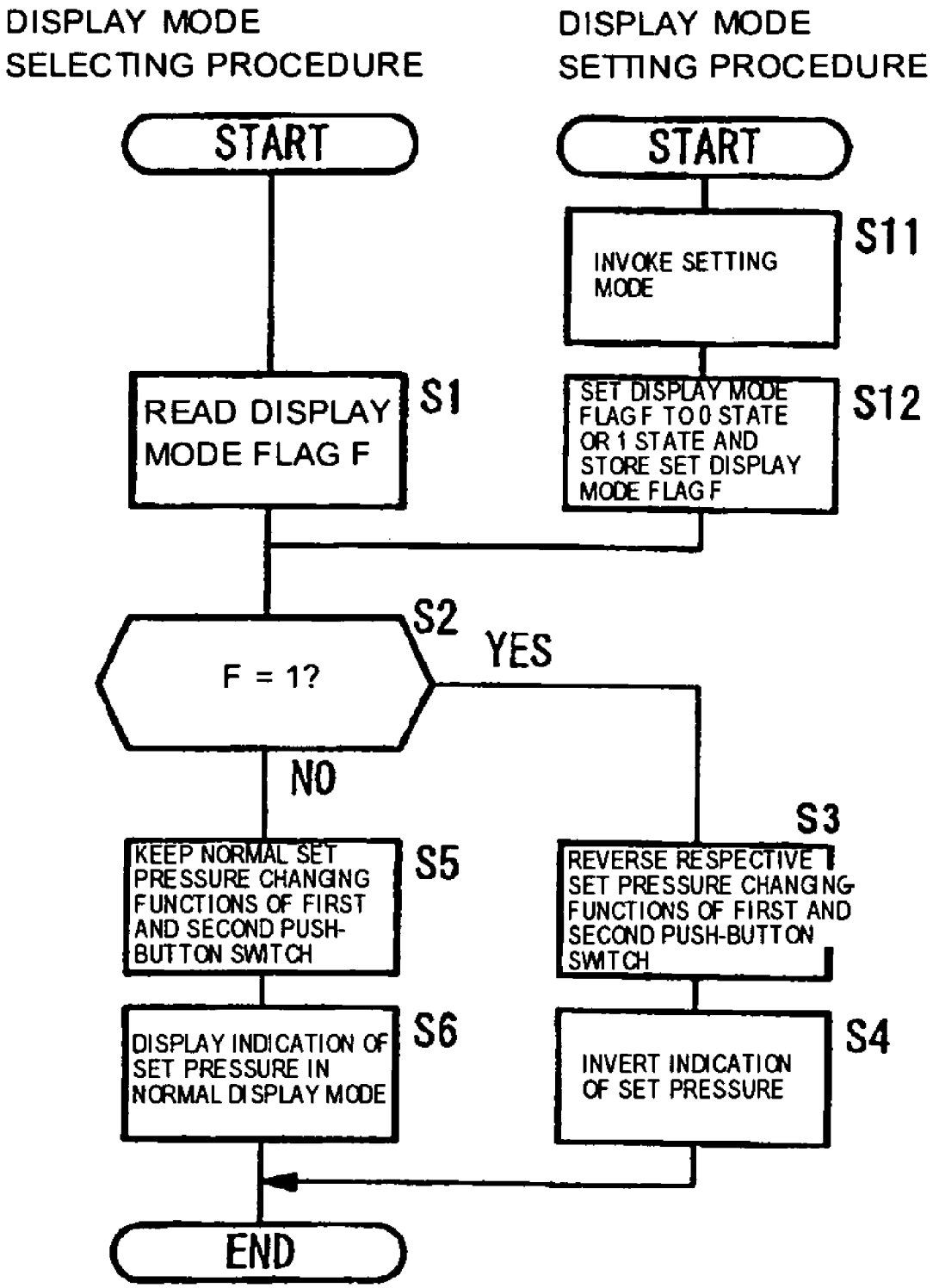
FIG. 6 is a flow chart of an indication inverting program.
Figure 7:
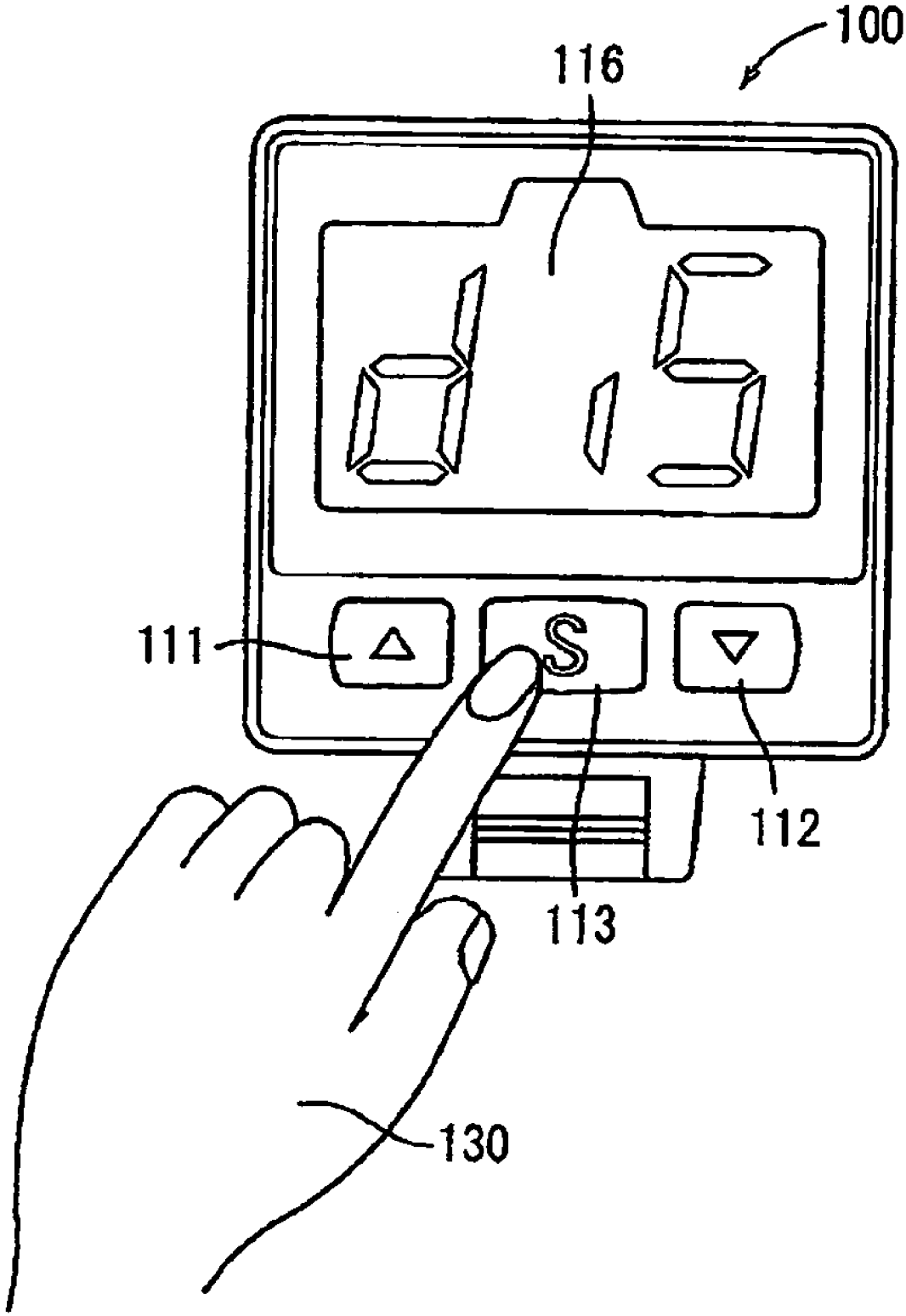
FIG. 7 is a front elevation of the pressure switch shown in FIG. 1 in a state after a display unit has been set in a setting mode by continuously depressing the push button of a setting push-button switch.

The indication turning function, which is an essential function of the present invention, will be described with reference to FIG. 6 showing a flowchart of a display mode selecting procedure and a display mode setting procedure stored in the EEPROM 102 and to be executed by the CPU 104.

First, a display mode selecting procedure having steps S1 to S6 to be executed in the measuring mode will be described, and then a display mode setting procedure to be executed will be described.

Display Mode Selecting Procedure

The CPU 104 reads a display mode flag F from the EEPROM 102 in step S1. A normal display mode is selected when the display mode flag F is set to the 0 state. An inverse display mode is selected when the display mode flag F is set to the 1 state.

A query is made in step S2 to see if the display mode flag F is set to the 1 state. If the response in step S2 is affirmative, the respective set pressure changing functions of the first push-button switch 111 and the second push-button switch 112 are reversed.

In step S4, an indication of a set pressure displayed on the screen of the display unit 116 is turned through an angle of 180°.

Consequently, the indication of the set pressure is displayed in an erect position on the inverted pressure switch 100R as shown in FIG. 5 to facilitate the normal recognition of the indication.

The push button of the push-button switch on the left side as viewed in FIGS. 3 and 5, namely, the push button of the first push-button switch 111 of the pressure switch 100N or the push button of the second push-button switch 112 of the pressure switch 100R, is pushed to increase the set pressure. The set pressure is increased by an increment of 0.01 kPa every time the same push button is pushed. The push button of the push-button switch on the right side as viewed in FIGS. 3 and 5, namely, the push button of the second push-button switch 111 of the pressure switch 100N or the push button of the first push-button switch 112 of the pressure switch 100R, is pushed to decrease the set pressure. The set pressure is decreased by a decrement of 0.01 kPa every time the same push button is pushed. Thus the set pressure can be increased or decreased by the one and the same sense of set pressure changing operation regardless of the position of the pressure switch 100.

When the display mode flag F is set to the 0 state and the response to the query in step S2 is negative, the set pressure increasing function of the first push-button switch 111 and the set pressure decreasing function of the second push-button switch 112 are kept unchanged in step S5.

In step S6, the indication of the set pressure is displayed in the normal display mode on the screen of the display unit 116 as shown in FIG. 3.

A set pressure setting operation in the setting mode will be described.

Display Mode Setting Procedure

When the push button of the mode setting push-button switch 113 is depressed continuously for 2 s or longer, a setting mode is invoked to execute a display mode setting procedure in step S11.

Figure 8:
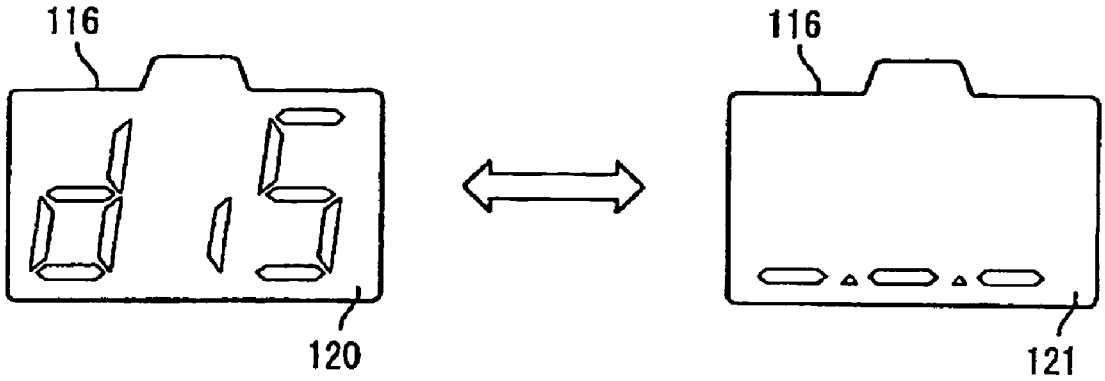
FIG. 8 is a view of assistance in explaining the alternate display of a flickering indication "diS" indicating the change of display mode and a flickering lower bar string.

In the setting mode, a flickering indication 120 "diS" indicating the change of display mode and a flickering lower bar string 121 indicating normal display are as shown in FIG. 8 are displayed alternately.

Figure 9:
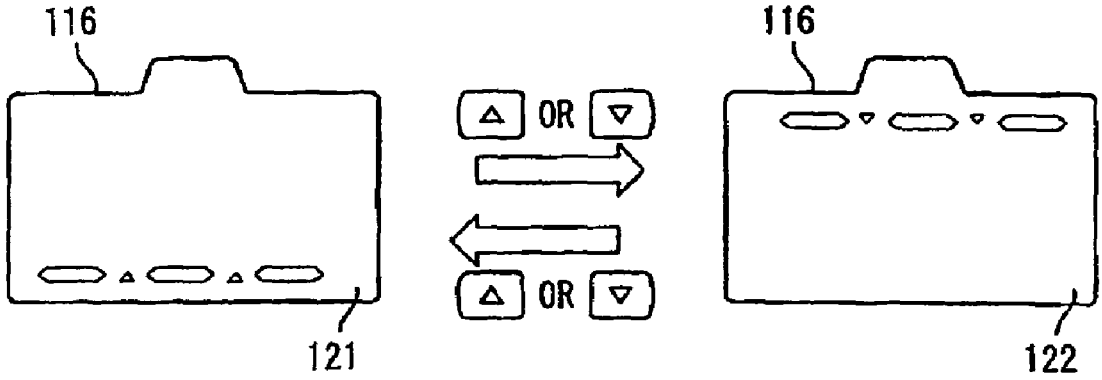
FIG. 9 is a view of assistance in explaining the alternate display of a lower bar string indicating a normal display mode and an upper bar string indicating inverse display mode.

Every time the push button of the first push-button switch 111 or the second push-button switch 112 is pushed once in the state shown in FIG. 8, the lower bar string 121 indicating a normal display mode and an upper bar string 122 indicating an inverse display mode are displayed alternately as shown in FIG. 9.

Then, in the state shown in FIG. 9, the push button of the mode setting push-button 113 is pushed to select either the lower bar string 121 indicating the normal display mode or the upper bar string 122 indicating the inverse display mode. In step S12, the display mode flag F stored in the EEPROM 101 is set to the 0 state or the 1 state depending on the selected display mode. Since the display mode flag F is written to the EEPROM 102, the selected display mode is held in the pressure switch 100 even if the pressure switch 100 is disconnected from the power supply.

The display mode setting procedure is ended by depressing the push button of the mode setting push-button switch 113 for 2 s or longer after the display mode has been set and the indication indicating the set pressure is displayed as shown in FIG. 3 or FIG. 5.

Even in a state where the operator is obliged to look at the display unit 116 of the pressure switch 100 from 1 a direction opposite the predetermined direction or in a state where the pressure switch 100 is installed in an inverted position, the indication displayed on the screen of the display unit 116 is turned through an angle of 180° and the respective set pressure changing functions of the first push-button switch 111 and the second push-button switch 112 are reversed by operating the push button of the mode setting push-button switch 113, namely, the indication turning push-button switch.

Therefore, the operator is able to recognize the erect numerical indication in the normal state even in the state where the pressure switch 100 is installed in an inverted position as shown in FIG. 5. Since the respective set pressure changing functions of the first push-button switch 111 and the second push-button switch 112 are reversed simultaneously with the turning of the indication through an angle of 180°, the operator does not need to change the sense of operating the first push button switch 111 and the second push-button switch 112.

Thus the indication on the pressure switch 100 is displayed in an erect position as shown in FIGS. 3 and 5 and is not inverted like the indication on the pressure switch 100AN shown in FIG. 4 and the operator is able to perform the set pressure increasing operation and the set pressure decreasing operation in the same sense of operation even if the pressure switch 100 is installed in an inverted position.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

We claim:

1. A pressure switch comprising:

a first push-button switch, a second push-button switch, a pressure sensor, a display unit for displaying a set pressure indication, a storage device storing programs, and a CPU that executes instructions specified by the programs, increases a set pressure when the first push-button switch is operated, decreases the set pressure when the second push-button switch is operated, makes the display unit display the set pressure and provides a detection signal upon the coincidence of a measured pressure measured by the pressure sensor with the set pressure;

wherein an indication turning push-button switch is connected to the CPU, the CPU turns the set pressure indication displayed by the display unit through an angle of 180° and executes, when the indication turning push-button switch is operated, a program for reversing function of the first push-button switch to increase the set pressure when the first push-button switch is operated and for reversing function of the second push-button switch to decrease the set pressure when the second push-button switch is operated.

* * * * *